United States Patent [19]

Morita et al.

[11] 4,310,819

[45] Jan. 12, 1982

[54] MAGNETIC BEAM ADJUSTING ARRANGEMENT

[75] Inventors: Toru Morita, Katano; Yasumasa Takahasi, Hirakata; Kohei Akamathu, Ikoma; Takasi Inothume, Gifu, all of Japan

[73] Assignee: Sanyo Electric Co., Ltd., Moriguchi, Japan

[21] Appl. No.: 149,491

[22] Filed: May 13, 1980

[30] Foreign Application Priority Data

May 17, 1979 [JP] Japan ..... 54-61154

[51] Int. Cl.[3] ..... H01F 1/00

[52] U.S. Cl. ..... 335/212; 335/210

[58] Field of Search ..... 335/210, 212, 213

[56] References Cited

U.S. PATENT DOCUMENTS

| | | | |
|---|---|---|---|
| 3,609,607 | 9/1971 | Sohma | 335/212 |
| 3,725,831 | 4/1973 | Barbin | 335/212 |
| 3,808,570 | 4/1974 | Thompson et al. | 335/212 |
| 4,091,347 | 5/1978 | Barbin | 335/212 |

*Primary Examiner*—George Harris

*Attorney, Agent, or Firm*—Darby & Darby

[57] ABSTRACT

A magnetic beam adjusting arrangement for use in adjusting static convergence in an in-line, tri-beam, cathode ray tube includes first and second U-shaped magnet elements, each rotatably and radially movably mounted on a neck section of the cathode ray tube. Each magnet element is polarized with three or five poles for adjusting the convergence of the beams at outer beam paths of a trio of in-line beams paths.

9 Claims, 17 Drawing Figures

MAGNETIC BEAM ADJUSTING ARRANGEMENT

BACKGROUND OF THE INVENTION

The present invention relates to a magnetic arrangement for beam position adjustment in a multiple-beam cathode ray tube, and more particularly, to a magnetic arrangement for adjusting static convergence of the plurality of electron beams in an in-line, tri-beam, color cathode ray tube.

In a tri-beam color cathode ray tube employing an in-line beam configuration, the electron beam sources are aligned to originate beam paths having axes lying essentially in a common plane, with a central beam path oriented in registry with the tube neck axis and with respective outer beam paths symmetrically disposed on opposite sides of the central beam.

For proper picture reproduction, it is desired that the three beams strike coincident regions of the phosphor screen of the cathode ray tube. While the gun structures of the cathode ray tube are designed ideally to effect such convergence of the beams at the screen center in the absence of beam deflection, practical tolerances in the manufacture of the cathode ray tube and associated components dictate the need for associating with the cathode ray tube suitable means for correcting a range of center-of-screen misconvergence errors that may be encountered in actual practice.

For this purpose, there have been proposed various magnetic arrangements for correcting the misconvergence and, one of which is disclosed in U.S. Pat. No. 3,725,831 issued to Barbin on Apr. 3, 1973. According to this reference, a pair of juxtaposed four-pole magnet rings and a pair of juxtaposed six-pole magnet rings are rotatably mounted about axially spaced regions of a tube neck section of the cathode ray tube.

Another arrangement is disclosed in Japanese Utility Model Publications No. 26593/1976 and No. 26594/1976 both issued to Yamada et al. on July 6, 1976. According to these references, a U-shaped member A carrying five permanent magnets M1, M2, M3, M4 and M5, as shown in FIG. 1, is rotatably mounted on the tube neck section. The magnetic flux (dotted line) produced between the magnets M2 and M4 affect on the magnetic flux (solid line) produced between north and south poles of the magnet M3 in such a manner that the outer magnetic flux from the magnet M3 is counterbalanced with the flux between the magnets M2 and M4 while the inner magnetic flux covering axial beam location B is aided with the flux between the magnets M2 and M4. Accordingly, the field at beam location B is directed downward to produce a leftward shift of the electron beam at location B, provided that electron motion is out from the plane of the paper in the view of FIG. 1. According to this arrangement, since the available magnetic flux direct only in one direction, i.e., from top to bottom in FIG. 1, the beam shift at location B can be directed, $\pm 90°$ from the arrow direction shown in FIG. 1 with respect to the rotation of the U-shaped member about the tube neck section. If it is required to shift the beam at location B rightwardly, it is necessary to draw out and turn over the U-shaped member A and then mount again the U-shaped member A to direct the available magnetic flux from bottom to top. Therefore, the adjustment for the beam shift direction required a number of steps, particularly when right and leftwards shift is involved.

The above mentioned arrangement has a disadvantage not only in the steps for adjusting the beam shift direction but also in the manufacturing steps particularly, the steps for mounting the magnetic pieces on the U-shaped member A.

SUMMARY OF THE INVENTION

Accordingly, it is a primary object of the present invention to provide a magnetic beam adjusting arrangement which is simple in construction and can readily be manufactured at low cost.

It is a further object of the present invention to provide a magnetic beam adjusting arrangement of the above described type which can control the beam shift in all directions through a simple adjustment.

In accomplishing these and other objects, a magnetic beam adjusting arrangement according to the present invention comprises a cylindrical holder adapted to be rigidly mounted on the neck of the cathode ray tube enclosing a trio of in-line beam paths. A central one of the in-line beam paths substantially coinciding with the longitudinal axis of the neck with the remaining outer ones of the in-line beam paths being substantially symmetrically disposed on opposite sides of said axis. The magnetic beam adjusting arrangement further comprises a first magnet element of a U-shaped configuration having two arms and a joint portion from which the two arms extend. The joint portion is magnetized with a first pole and an intermediate portion of the respective arms is magnetized with a second pole. The first magnet element is rotatably and radially movably mounted on the holder so as to adjust one of the two outer beam paths by the magnetic field produced by the first magnet element. A second magnet element of a U-shaped configuration is provided, having two arms and a joint portion from which the two arms extend. The joint portion is magnetized with the first pole and an intermediate portion of the respective arms is magnetized with the other pole. The second magnet element is also rotatably and radially movably mounted on the holder so as to adjust other of the two outer beam paths by the magnetic field produced by the second magnet element.

According to one preferred arrangement, each of the first and second magnet element is further polarized with the first pole at end portion of the respective arms remote from the joint portion.

BRIEF DESCRIPTION OF THE DRAWINGS

These and other objects and features of the present invention will become apparent from the following description taken in conjunction with preferred embodiment thereof with reference to the accompanying drawings, throughout which like parts are designated by like reference numerals, and in which.

DETAILED DESCRIPTION OF THE INVENTION

Figure 1:
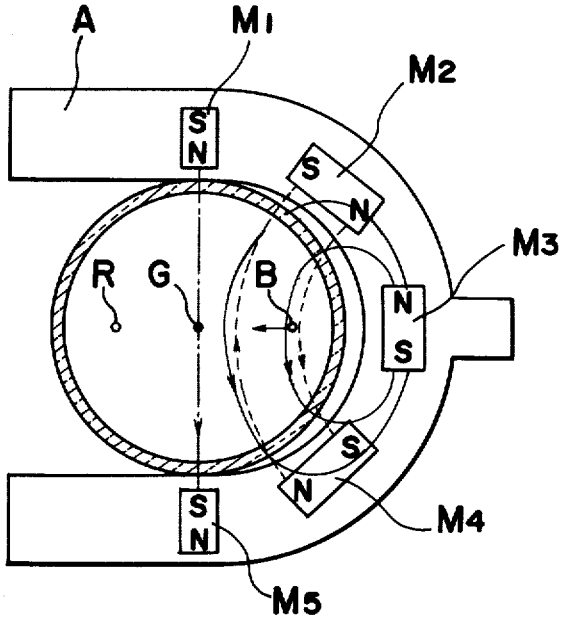
Fig. 1 Prior Art
FIG. 1 is a schematic view showing a magnetic beam adjusting arrangement according to the prior art.
Figure 2:
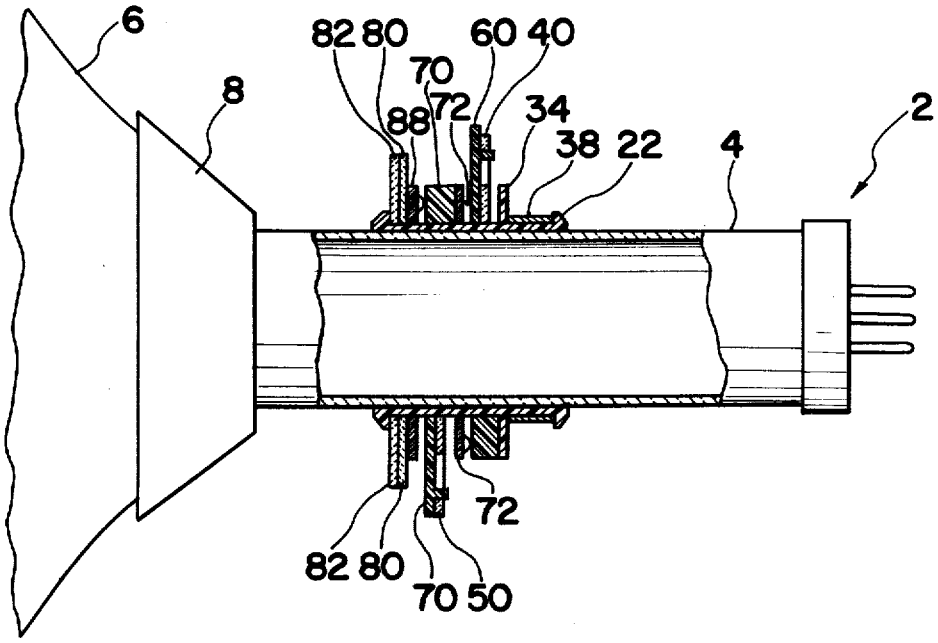
FIG. 2 is a fragmentary sectional view showing a manner in which a magnetic beam adjusting arrangement of the present invention is mounted on the cathode ray tube.

Referring to FIG. 2, an in-line, tri-beam cathode ray tube 2, having at its base end a cylindrical neck section 4 extending from a funnel portion 6, is illustrated in assembly with associated external neck components. The neck components include deflection yoke apparatus 8 encircling the forward end of the neck section 4. To the rear of the deflection yoke 8 are the remaining neck components including a purity magnet assembly 10 and a static convergence arrangement 12 which are mounted on a holder 22 encircling the neck section 4.

Figure 4:
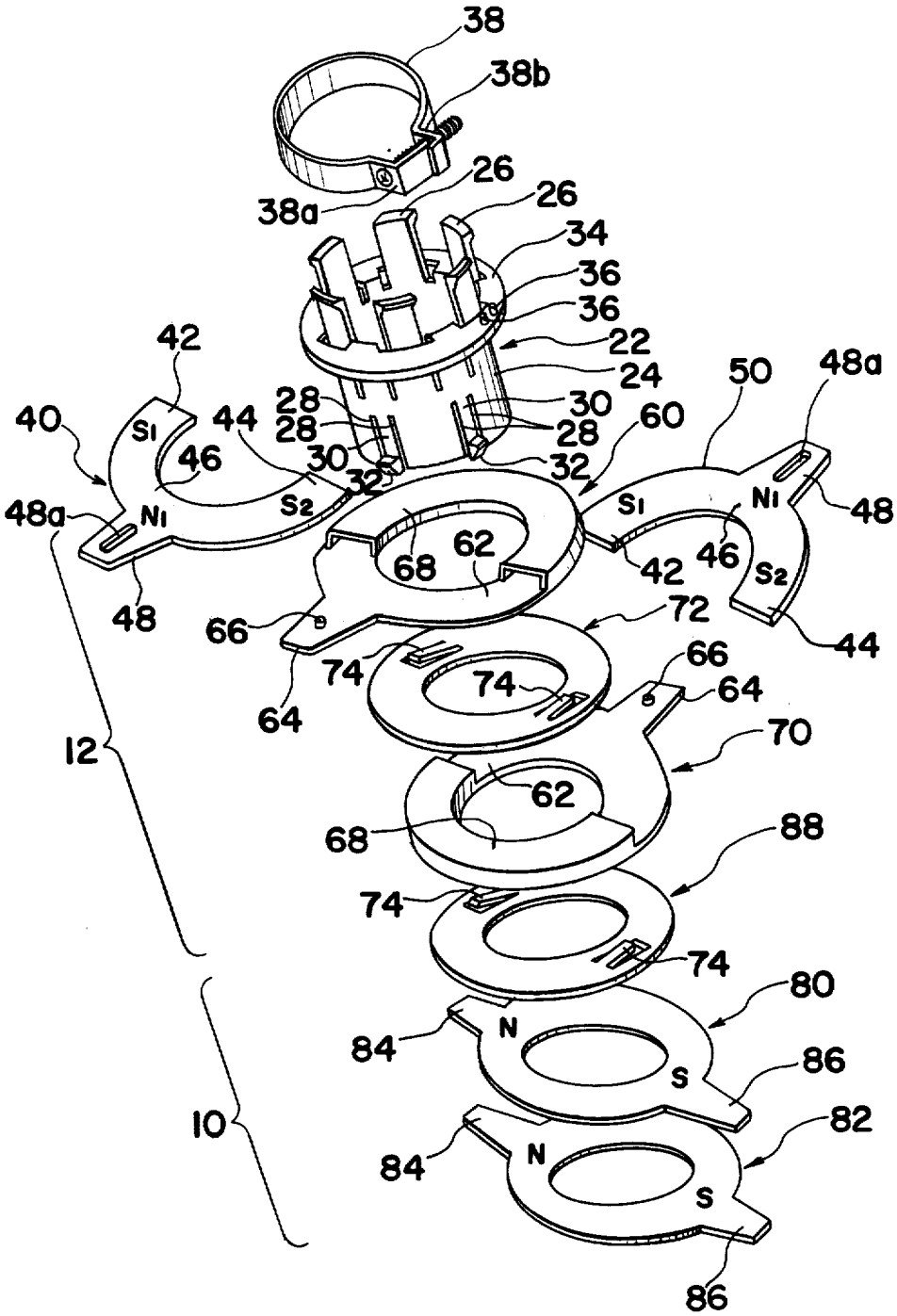
FIG. 4 is an exploded view of the magnetic beam adjusting arrangement of FIG. 3.

As better shown in the exploded view of FIG. 4, the holder 22 made of synthetic resin includes a cylindrical body 24 with a plurality of tongues 26 extending upwardly from one end edge of the body 24. The other end edge of the cylindrical body 24 is formed with a plurality of slits 28 in pairs for defining a plurality of, e.g., four, resilient strips each between the slits 28 in a pair. The end edge of the resilient strip 30 is provided with a detent projection 32 extending outwardly from the body 24. The holder 22 further includes a collar 34 rigidly mounted on the cylindrical body 24 in such a manner as to surround the intermediate portion of the tongue 26. At least two pins 36 are provided on the collar 34 which are positioned adjacent to each other and aligned along the perimeter of the collar 34. The holder 22 is tightly mounted on the neck section 4 by a fastening belt 38 made of a metal plate which is so designed that the opposite ends thereof are bent at 38*a* and 38*b*, respectively, to protrude in a direction radially outwardly from the body of the belt 38 when it surrounds the tongues 26. These ends 38*a* and 38*b* are connected together by a screw threaded through one of these ends. For positioning the belt 38, one of the ends 38*a* and 38*b* is held between the two pins 36.

The static convergence arrangement 12 includes two permanent magnets 40 and 50 made of barium ferrite or steel each having a U-shape with a pair of arms 42 and 44. An intermediate or joint portion 46 of each of the magnets 40 and 50 is provided with a tab 48 protruding laterally in a direction opposite to the arms 42 and 44. A slit 48*a* is formed in the tab 48 extending perpendicularly to the portion 46. Each of the permanent magnets 40 and 50 has a three-pole magnetization pattern, in which a north pole N1 is located at the intermediate portion 46, while south poles S1 and S2 are located at an intermediate portion of the respective arms 42 and 44 at approximately 60° interval from the north pole N1. The permanent magnets 40 and 50 are rotatably and shiftably mounted on the holder 22 by a respective support member described in detail below in such a manner that an imaginary plane defined between the arms 42 and 44 perpendicularly crosses the neck section 4.

The support member 60 for supporting the permanent magnet 40 is made of synthetic resin and has a ring portion 62 rotatably mounted on the body 24 of the holder 22 adjacent the collar 34. A projection 64 extends laterally outwards from the ring portion 62 to facilitate manual adjustment of its rotational position. A pin 66 projects perpendicularly from the projection 64 at about a center portion of the projection 64. A generally U-shaped hood 68 is provided on the ring portion 62 to cover approximately half the ring portion 62, and is so positioned that the opposite ends of the hood 68 are situated equidistantly from the projection 64. For supporting the permanent magnet 40, the two arms 42 and 44 of the of the permanent magnet 40 are inserted into the hood 68 from its opposite ends and, at the same time, the pin 66 of the support member 60 is slidingly inserted into the slit 48*a* of the permanent magnet 40. To adjust the rotational position of the permanent magnet 40, the permanent magnet 40 is rotated about the cylindrical body 24 together with the support member 60, and to adjust its shifted position, the tab 48 of the permanent magnet 40 is pulled or pushed against the support member 60 in the direction parallel to the slit 48*a* for shifting the permanent magnet 40 in a radial direction with respect to the cylindrical body 24. Since the arms 42 and 44 are fittingly inserted into the hood 68, the permanent magnet 40 can be secured to its shifted position.

Another support member 70 is rotatably mounted on the body 24 of the holder 22 and has the same structure as that of the above mentioned support member 60 for rotatably and shiftably supporting the permanent magnet 50. For maintaining a predetermined distance between the permanent magnets 40 and 50, a spacer ring 72 made of synthetic resin is mounted between the support members 60 and 70. The spacer ring 72 has a pair of U-shaped cuts diametrically spaced about the ring periphery to form a respective rectangular plate 74. Each rectangular plate 74 is bent upwards to form a leaf spring therewith by its own resiliency.

The purity magnet assembly 10 includes two permanent magnet rings 80 and 82 made of barium ferrite or steel, each formed with a pair of projecting tabs 84 and 86 to facilitate manual adjustment of the rotational position of the ring about the body 24. Each of the rings 80 and 82 has a two-pole magnetization pattern in which a north pole location is diametrically opposed to a south pole location. Another spacer ring 88 having the same structure as that of the spacer ring 72 is mounted on the body 24 between the purity magnet assembly 10 and the convergence arrangement 12.

Figure 3:
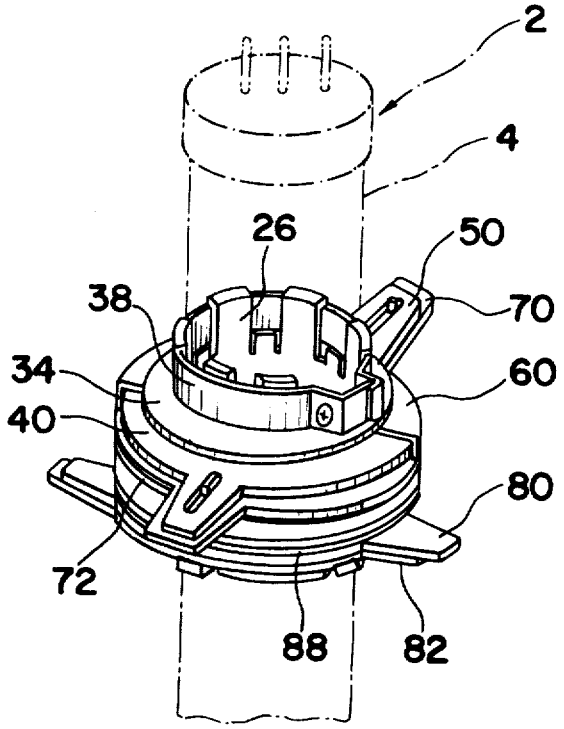
FIG. 3 is a perspective view of the magnetic beam adjusting arrangement of the present invention.

When the purity magnet arrangement 10 and the static convergence arrangement 12 are mounted on the holder 22, they are held in the mounted position by the engagement of the detend projection 32 with the rearmost ring 82, as shown in FIG. 3.

Figure 5A:
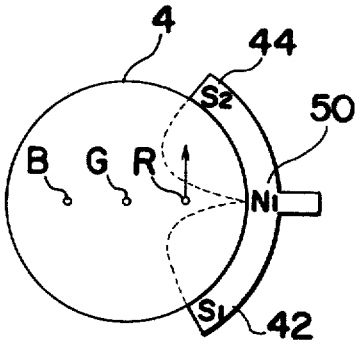
FIGS. 5*a* to 5*i* are schematic views showing various orientations of one three-pole magnet element with respect to the neck section of the cathode ray tube.

The diagrammatic showing of FIGS. 5*a* to 5*i* illustrate the nature of the beam position shift that result from the field of the permanent magnet 50 in various orientations. In the orientation of FIG. 5*a*, permanent magnet 50 is positioned with its north pole N1 aligned in line with the axial beam locations B, G and R, and south poles S1 and S2 positioned above and below the axial beam location R. With the indicated orientation, the field at beam location R is laterally directed with a polarity producing an upward shift of the electron beam at location R (electron motion being out from the plane of the paper in the views of FIGS. 5*a*, et seq.).

Figure 5B:
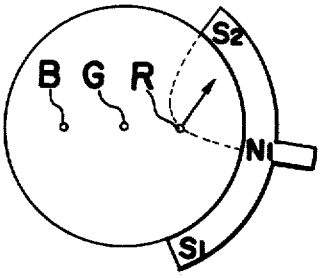
Figure 5C:
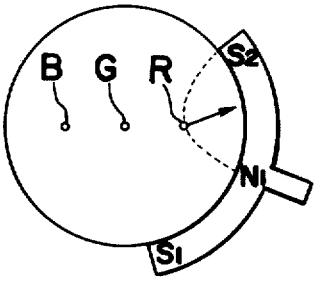

In the orientation of FIG. 5*b*, permanent magnet 50 has been rotated about 10° clockwise from its FIG. 5*a* position. In the FIG. 5*b* position, the field at axial beam location R is determined by the magnetic flux between the north pole N1 at the center and the south pole S2 in the upper arm 44 of the permanent magnet 50. Thus, the field at location R is directed diagonally leftward and upward. Accordingly, the resultant beam position shift at location R is upward and rightward. FIG. 5*c* illustrates that a further clockwise rotation of the permanent magnet 50 result in further rightward beam position shift.

Figure 5D:
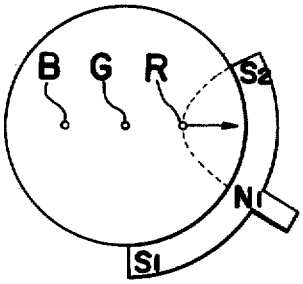

In the orientation of FIG. 5*d*, permanent magnet 50 has been rotated about 30° clockwise to position the north pole N1 and south pole S2 equidistantly from the beam location R. In the FIG. 5*d* position, the field direction at location R is vertically upward with a polarity producing a rightward shift of the electron beam at location R. A further clockwise rotation of the magnet 50 from its FIG. 5*d* position turns the beam shift direction downwardly.

Figure 5E:
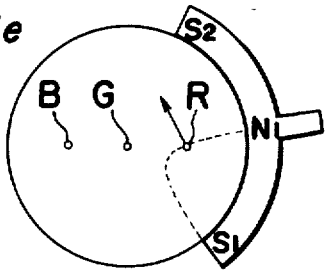
Figure 5F:
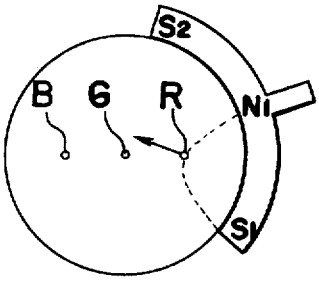
Figure 5G:
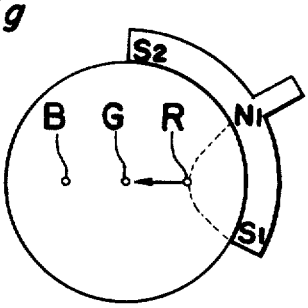

In the orientation of FIG. 5*e*, permanent magnet 50 has been rotated about 10° counterclockwise from its FIG. 5*a* position. In the FIG. 5*e* position, the field at axial beam location R is determined by the magnetic flux between the north pole N1 and the south pole S1. Thus, the field at axial beam location R is directed diagonally leftward and downward. Accordingly, the resultant beam position shift at location R is upward and leftward. FIG. 5*f* illustrates that a further counterclockwise rotation of the permanent magnet 50 result in further leftward beam position shift. When the permanent magnet 50 is so rotated to position the north pole N1 and south pole S1 equidistantly from the beam location R, as shown in FIG. 5*g*, the field direction at location R is vertically downward to produce a leftward shift of the electron beam at location R. A further counterclockwise rotation of the magnet 50 from its FIG. 5*g* position turns the beam shift direction downwardly.

As suggested by the arrow directions and lengths in FIGS. 5*a* to 5*g*, the beam shift directions at location R are different, but the beam shift magnitudes are about the same. In other words, so long as the permanent magnet 50 rotates over the perimeter of the neck section 4 near the location R, the beam position shifts at the location R by the magnet 50 are effected approximately by the same magnitude of force. Only the shifting directions are different. Furthermore, by the rotation of of permanent magnet 50, beam shifting direction at location R can be changed to any desired direction, i.e., 360° about the location R.

Figure 5H:
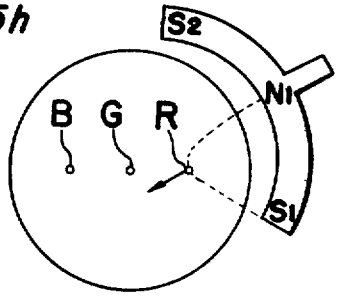

In the orientation of FIG. 5*h*, permanent magnet 50 has been shifted radially away from the neck section 4 from its FIG. 5*g* position. In the FIG. 5*h* position, the field at axial beam location R is directed diagonally downward and rightward. Thus, the beam position shift at the location R is directed diagonally leftward and downward with the beam shift magnitude being decreased when compared with those described in connection with FIGS. 5*a* to 5*g*.

Figure 5I:
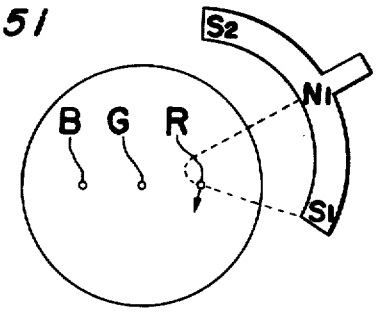

In the orientation of FIG. 5*i*, permanent magnet 50 has been further shifted radially away from the neck section 4. The resultant beam position shift at location R is downward with the beam shift magnitude being further reduced. A further shifting of the permanent magnet 50 radially away from the neck portion 4 will result in no beam position shift.

It is understood that the shifting of the permanent magnet 50 radially away from and towards the neck section 4 controls the magnitude of force of the beam position shift and, at the same time, controls the shifting direction.

Figure 6:
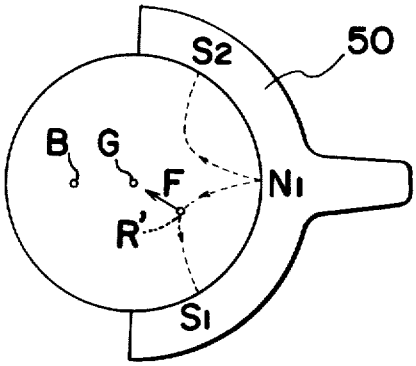
FIG. 6 is a schematic view showing one orientation of one magnet element when the beam position is deviated.

Although the foregoing description given in connection with FIGS. 5*a* to 5*i* is directed to the beam shift at the location R by the use of permanent magnet 50, a similar beam shift at the location B can be carried out by the use of permanent magnet 40. Furthermore, the permanent magnets 50 and 40 can effect the beam shift not only at the locations R and B but any other location in the neck portion 4. For example, FIG. 6 shows the beam shift at the location R′ effected by the permanent magnet 50.

In contrast with the previously described effects of the permanent magnets 40 and 50, the two permanent magnet rings 80 and 82 in the purity magnet assembly 10 have an effect on all three beams for adjusting the angle of approach of the three beams to the cathode ray tube's shadow-mask to ensure landing of each beam on the appropriate phosphor area to establish optimum purity. Since this effect is well known in the prior art, such as disclosed in U.S. Pat. No. 3,725,831, a further description therefor is omitted for the sake of brevity.

Figure 7:
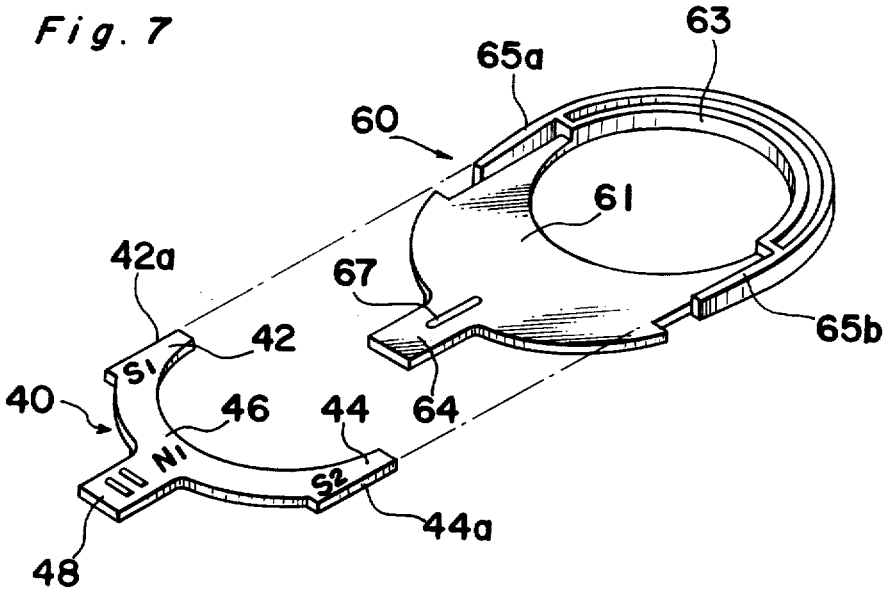
FIG. 7 is a perspective view showing a modification of a support member together with a magnet element.

Referring to FIG. 7, a modification of the permanent magnet, e.g., 40 and the support member, e.g., 60 is shown. The permanent magnet 40 in this modification has a pair of parallel sides 42*a* and 44*a* at the outer edge end portion of the respective arms 42 and 44. Indents are provided on the tab 48 for facilitating the manual shifting of the permanent magnet 40. Instead of forming the slit in the tab 48, as described in the previous embodiment, a pin is provided under the tab 48 which slidingly engages with a slit 67 formed in the support member 60. The support member 60 has an oval plate 61 with a circular opening 63 formed at one end portion of the plate 61. The projection 64 laterally extends from the other end of the plate 61. A pair of resilient walls 65*a* and 65*b* extend along the opposite sides of the oval plate 61 with one end of each wall fixed to the plate 61 at places adjacent the opening while the other end is free. The distance between the free ends of the walls 65*a* and 65*b* is slightly shorter than the distance between their fixed ends, and the distance between the inner surface of the walls 65*a* and 65*b* at their fixed end is slightly greater than the distance between the sides 42*a* and 44*a* of the permanent magnet 40 so as to hold the permanent magnet 40 between the resilient walls 65*a* and 65*b* as the permanent magnet 40 shifts over the plate 61 with its sides 42*a* and 44*a* sliding over the inner surfaces of the walls 65*a* and 65*b*.

Although it has been described that each of the permanent magnets 40 and 50 has a three-pole magnetization pattern, it is possible to arrange the permanent magnets 40 and 50 with a five-pole magnetization pattern. The five poles are symmetrically positioned about the arms 42 and 44 alternatingly in polarity. More particularly, with reference to the first north pole N1 located at the intermediate portion 46, first and second south poles S1 and S2 are located 45° above and below the north pole N1, respectively, while second and third north poles N2 and N3 are located 90° above and below the north pole N1, respectively, as shown in FIGS. 8*a* and 8*b*.

Figure 8A:
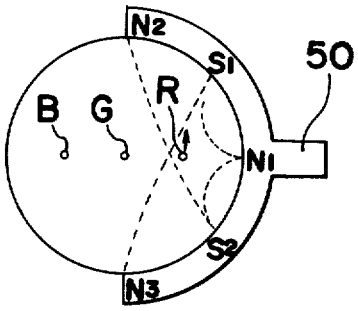
FIGS. 8*a* and 8*b* are schematic views showing orientations of one five-pole magnet element with respect to the neck section of the cathode ray tube.

When the five-pole permanent magnet 50 is oriented in the position shown in FIG. 8*a*, in which the first north pole N1 is located in alignment with the axial beam locations B, G and R, the field at beam location R is determined by the north pole N1 and also by the magnetic flux between second north pole N2 and second south pole S2 and between third north pole N3 and first south pole S1. The north pole N1 presents leftwardly directing field whereas the magnetic flux between poles N2 and S2 and between poles N3 and S1 present rightwardly directing field. Since the former field has greater effect than the latter field, the field at beam location R is laterally directed leftwards, thus resulting in upward shift of the beam at location R. It will be noted that the magnitude of the shift by the five-pole permanent magnet 50 is not as large as that by the three-pole permanent magnet 50.

Figure 8B:
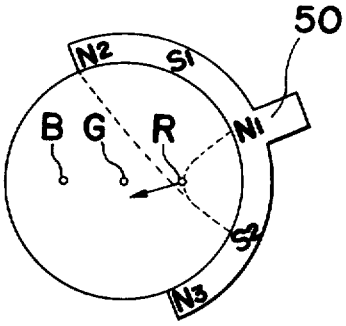

In the orientation of FIG. 8*b*, permanent magnet 50 has been rotated about 22.5° counterclockwise from its FIG. 8*a* position. In the FIG. 8*b* position, the field at beam location R is determined by the magnetic flux between first north pole N1 and second south pole S2 and between second north pole N2 and second south pole S2. The magnetic flux between poles N1 and S2 present vertically downward directing field, whereas the magnetic flux between poles N2 and S2 present diagonally rightward and downward directing field. Accordingly, the beam shift at location R is directed diagonally leftward and downward.

When the five-pole permanent magnet 50 is used, the beam shift control can be carried out with less degree of rotation thereof than that necessary when three-pole permanent magnet 50 is used. More particularly, in the case of three-pole permanent magnet 50, it is necessary to rotate the magnet 50 30° counterclockwise, i.e., from the FIG. 5*a* position to the FIG. 5*g* position, to turn the beam shift direction 90°, i.e., from upward direction to leftward direction. Whereas in the case of five-pole permanent magnet 50, 22.5° counterclockwise rotation of the magnet 50 results in more than 90° rotation of the beam shift direction, as understood from FIGS. 8*a* and 8*b*.

It is to be noted that the positions of the poles in three-pole permanent magnet are not necessarily 60° apart from each other. Preferably, they should be apart from each other 60°±5%. Similarly, in the five-pole permanent magnet, the poles should preferably be apart from each other 45°±5%.

Furthermore, each of the permanent magnets can be magnetized with opposite polarities. For example, in the case of three-pole permanent magnet, the intermediate portion 46 can be magnetized with south pole instead of north pole, while the arms 42 and 44 can be magnetized with north pole.

Although the present invention has been fully described with reference to a preferred embodiment, many modifications and variations thereof will now be apparent to those skilled in the art, and the scope of the present invention is therefore to be limited not by the details of the preferred embodiment described above, but only by the terms of the appended claims.

What is claimed is:

1. A magnetic beam adjusting arrangement for use in adjusting static convergence in an in-line, tri-beam, cathode ray tube having a cylindrical neck enclosing a trio of in-line beam paths, a central one of said in-line beam paths substantially coinciding with the longitudinal axis of said neck with the remaining outer ones of said in-line beam paths being substantially symmetrically disposed on opposite sides of said axis, said magnetic beam adjusting arrangement comprising:

a cylindrical holder adapted to be rigidly mounted on the neck of said cathode ray tube;

a first magnet element of a U-shaped configuration having two arms and a joint portion from which the two arms extend, said joint portion being magnetized with a first pole and an intermediate portion of the respective arms being magnetized with a second pole, said first magnet element being rotatably and radially movably mounted on the holder so as to adjust one of the two outer beam paths by the magnetic field produced by the first magnet element; and a second magnet element of a U-shaped configuration having two arms and a joint portion from which the two arms extend, said joint portion being magnetized with the first pole and an intermediate portion of the respective arms being magnetized with the second pole, said second magnet element being rotatably and radially movably mounted on the holder so as to adjust other of the two outer beam paths by the magnetic field produced by the second magnet element.

2. A magnetic beam adjusting arrangement as claimed in claim 1, wherein in each of the first and second magnet elements, said second poles are angularly spaced 60°±5% from said first pole about the center of the cylindrical holder when the first and second magnet elements are held attachingly against the holder.

3. A magnetic beam adjusting arrangement as claimed in claim 1, wherein each of said first and second magnet element is further polarized with the first pole at end portion of the respective arms remote from the joint portion.

4. A magnetic beam adjusting arrangement as claimed in claim 3, wherein in each of the first and second magnet elements, said second poles are angularly spaced 45°±5% from said first pole at said joint portion, and said first poles at end portion of the arms are angularly spaced 90°±5% from said first pole at said joint portion about the center of the cylindrical holder when the first and second magnet elements are held attachingly against the holder.

5. A magnetic beam adjusting arrangement as claimed in claim 1 or 3, wherein said first and second poles are north and south poles, respectively.

6. A magnetic beam adjusting arrangement as claimed in claim 1 or 3, further comprising a spacer ring member mounted on the holder between the first and second magnet elements.

7. A magnetic adjusting arrangement as claimed in claim 1 or 3, further comprising first and second support members for supporting said first and second magnet elements, respectively.

8. A magnetic beam adjusting arrangement as claimed in claim 7, wherein each of said first and second support members includes a ring member rotatably mounted on the holder and a hood member covering approximately half the ring member for slidingly receiving the arms into the hood from its opposite open ends.

9. A magnetic beam adjusting arrangement as claimed in claim 7, wherein each of said first and second support members includes a ring member rotatably mounted on the holder and a pair of facing walls having their one end rigidly connected to the diametrically spaced peripheral sides of the ring member to hold the magnetic element between the facing walls.

* * * * *